US009583028B2

(12) United States Patent
Killion et al.

(10) Patent No.: US 9,583,028 B2
(45) Date of Patent: Feb. 28, 2017

(54) FLASHLIGHT

(71) Applicant: Thomas Killion, Indianapolis, IN (US)

(72) Inventors: Thomas Killion, Indianapolis, IN (US); Samuel Werth, Indianapolis, IN (US); John Pell, Danville, IN (US)

(73) Assignee: Thomas Killion, Indianapolis, IN (US)

( * ) Notice: Subject to any disclaimer, the term of this patent is extended or adjusted under 35 U.S.C. 154(b) by 16 days.

(21) Appl. No.: 14/818,085

(22) Filed: Aug. 4, 2015

(65) Prior Publication Data

US 2016/0033092 A1 Feb. 4, 2016

Related U.S. Application Data

(60) Provisional application No. 62/032,774, filed on Aug. 4, 2014.

(51) Int. Cl.

| | |
|---|---|
| ***F21V 9/16*** | (2006.01) |
| ***G09F 13/10*** | (2006.01) |
| ***F21V 7/00*** | (2006.01) |
| ***F21L 4/02*** | (2006.01) |
| *F21V 23/04* | (2006.01) |
| *F21V 7/09* | (2006.01) |
| *F21Y 101/00* | (2016.01) |

(52) U.S. Cl.

CPC ..... *G09F 13/10* (2013.01); *F21L 4/027* (2013.01); *F21V 7/0075* (2013.01); *F21V 7/09* (2013.01); *F21V 23/0428* (2013.01); *F21Y 2101/00* (2013.01); *F21Y 2103/10* (2016.08); *F21Y 2115/10* (2016.08)

(58) Field of Classification Search

CPC ..... F21L 7/00; F21L 4/00; F21L 4/027; G09F 21/02; B43K 24/03; B43K 24/08; B43K 29/10; B43K 23/004; B43K 23/008; F21V 23/0414; F21Y 2101/00

USPC ..... 40/555

See application file for complete search history.

(56) References Cited

U.S. PATENT DOCUMENTS

| | | | |
|---|---|---|---|
| 2,019,884 | A | 11/1935 | Beaumont |
| 2,584,569 | A | 2/1952 | Frentzel |
| 2,870,741 | A | 1/1959 | Kersten |
| 2,978,723 | A | 4/1961 | Hopkins |
| 4,028,540 | A | 6/1977 | Key et al. |
| 4,122,510 | A | 10/1978 | Halliday |
| 4,167,347 | A | 9/1979 | Hoyle |

(Continued)

OTHER PUBLICATIONS

Excerpts taken from www.bentcil.com via the Wayback Machine (www.archive.org) dated at or prior to Aug. 1, 2015.

*Primary Examiner* — Shin Kim

(74) *Attorney, Agent, or Firm* — Indiano & McConnell, LLC; E. Victor Indiano

(57) ABSTRACT

A flashlight includes a casing having a first end, a second end, a first side surface and a second side surface. The casing has a first casing member joined to a second casing member, with the first and second casing members defining an interior cavity there between. An electronics package is provided that includes a power source, an actuable switch member and a light array coupled to the power source and switch member. The light source is capable of projecting light outwardly from the first end of the flashlight and into a cavity. The first casing member includes a light passable portion through which the light projected into the cavity can pass to the exterior of the cavity.

20 Claims, 10 Drawing Sheets

(56) References Cited

U.S. PATENT DOCUMENTS

| | | | | |
|---|---|---|---|---|
| 4,168,129 | A | | 9/1979 | Hernring |
| 4,176,979 | A | | 12/1979 | Saida |
| 4,237,527 | A | | 12/1980 | Breedlove |
| 4,347,553 | A | | 8/1982 | Saron |
| 4,381,158 | A | | 4/1983 | Garganese |
| 4,399,495 | A | | 8/1983 | Leopoldi et al. |
| 4,526,547 | A | | 7/1985 | Rusk |
| 4,832,604 | A | | 5/1989 | Rusk |
| D331,982 | S | | 12/1992 | George |
| D356,175 | S | | 3/1995 | Yau |
| D363,564 | S | | 10/1995 | Kish et al. |
| D374,495 | S | | 10/1996 | Garrity |
| 5,673,996 | A | | 10/1997 | Ducker |
| D425,231 | S | | 5/2000 | Lynch et al. |
| D481,816 | S | | 11/2003 | Sharrah et al. |
| D486,936 | S | | 2/2004 | Shiu |
| 6,773,191 | B2 | | 8/2004 | Killion |
| D497,020 | S | | 10/2004 | Lee |
| D510,637 | S | | 10/2005 | Chan |
| D524,972 | S | | 7/2006 | Shiu |
| 7,101,102 | B2 | | 9/2006 | Sawa |
| D542,952 | S | | 5/2007 | Bhavnani |
| 7,226,229 | B1 | | 6/2007 | Register |
| D580,078 | S | | 11/2008 | Lee |
| D602,186 | S | | 10/2009 | Lee |
| D615,676 | S | | 5/2010 | Lee |
| D627,497 | S | | 11/2010 | Jiang |
| D636,509 | S | | 4/2011 | Killion et al. |
| D636,510 | S | | 4/2011 | Killion et al. |
| D683,059 | S | * | 5/2013 | Rea ..... D26/63 |
| 2005/0231941 | A1 | | 10/2005 | Juang |
| 2006/0171762 | A1 | | 8/2006 | Mayne |
| 2008/0095568 | A1 | | 4/2008 | Hsien |
| 2008/0101847 | A1 | | 5/2008 | Lapstun et al. |
| 2010/0110670 | A1 | | 5/2010 | Killion |
| 2010/0157581 | A1 | | 6/2010 | Galli |

* cited by examiner

FLASHLIGHT

PRIORITY DATA

The instant application claims benefit of priority to Thomas Killion and John Pell and Sam Werth U.S. Provisional Patent Application Number Ser. No. 62/032,774 that was filed on 4 Aug. 2014, and which is fully incorporated herein by reference.

TECHNICAL FIELD OF THE INVENTION

The present invention relates to flashlights, and more particularly, to a flashlight having particular utility for use in the promotional, collateral and affinity products industry.

BACKGROUND OF INVENTION

Traditional flashlights usually include a housing that comprises a generally cylindrical casing having a hollow interior into which batteries are received. In order to provide strength to the flashlight and protect the batteries, the casing is normally made from a hard, rigid plastic or metal material. Battery contacts and wiring are disposed within the interior of the hard plastic or metal casing.

One end of the casing is typically closed, and the other end of the casing is open. The open end of the casing often includes a threaded end surface for threadedly receiving a light assembly that when joined to the casing forms a part of the overall flashlight housing. The light assembly includes an axially facing, radially extending lens cover, that covers over a highly reflective parabolic or conical dish. A light bulb that may be either an incandescent or an LED bulb is placed at the base of the dish to project light outwardly through the lens cover.

A switch member is usually mounted on the outwardly facing, cylindrical side surface of the flashlight. Typically, either a push button-type switch or a slide switch is employed to enable the user to turn the light on and off. Examples of such flashlights are shown in Shiu, U.S. Pat. No. D524,972; Lynch, U.S. Pat. No. D425,231; and Leopoldi, U.S. Pat. No. 4,399,495.

Flashlights of this type have been produced in many sizes and shapes and have been used for many years, and are still in widespread use. Although such flashlights are often large and cumbersome, they have significant utility because the size of the interior of the rigid casing can be made large enough to hold a plurality (e.g. 1-5) of large batteries, such as C or D cells, to provide the flashlight with sufficient candle power (or lumens) to cast a bright light on the surrounding areas, and sufficient power reserves to produce light for relatively long periods of time. Because of this large battery capacity, flashlights of this type are often used in work and safety-related applications and are often carried by police officers, firemen, guards and other security and safety personnel.

Additionally, the Applicants have been inventors in the field of flashlights and other lighted devices. See, Killion, U.S. Pat. No. 6,773,991; Killion et al., U.S. Pat. No. D636,509; Killion et al., U.S. Pat. No. D636,510; and Killion, Published Patent Application No. 2010/0110670 A1.

Although the rigid casing of the flashlights described above are usually cylindrical, advances in battery and light bulb technology have permitted designers to expand beyond the confinement of typically employed cylindrical shapes. For example, a large number of "flat casing" flashlights exist that employ more compact batteries and advanced technology bulbs such as LED bulbs. See, e.g. Lee, U.S. Pat. No. D549,862.

One significant technological development that has benefited flashlights relates to the use of LED lights. As LED lights consume significantly less electrical power than incandescent lights, manufacturers have been able to produce flashlights that are smaller and less expensive. Size can be reduced because smaller cylindrical batteries and coin-shaped and sized batteries can be used to power the flashlight in place of the larger C and D cell batteries typically used to power flashlights having incandescent lights.

The combination of LED lights and better battery technology has given flashlight manufacturers the ability to construct flashlights that are smaller and less expensive than previously known flashlights. These technological advances have allowed manufacturers to build flashlights that are inexpensive enough to both be disposable and to serve as value-priced promotional product items. Flashlights have now become disposable as a practical/economic matter, as they are inexpensive enough so that manufacturers often do not provide a vehicle to enable the user to change the battery in the flashlight, assuming that the user will throw it away when the batteries expire.

The inexpensive cost at which these flashlights can be produced has also caused flashlights to become increasingly popular promotional product items. A promotional product item is an item that is typically manufactured by a first company (Company A), and is purchased by a second company (Company B) who places their (Company B) logo or other visual indicia on to the particular product. Other examples of promotional product like items are collateral merchandise and affinity products. The common thread between these products that they include an indicia of some sort that is printed onto or attached as a sticker, such as a decal to the product. For example, the indicia can take the form of an aesthetic-based indicia such as an attractive design such as a picture of a monument, landscape or animal; or of a "collateral merchandise" type indicia such as a picture or logo of a race car, sports figure, sports team, theme park, cartoon character, celebrity or super hero. Additionally, the indicia can be an image that relates to an affinity group such as a fraternity, club, school, team or organization.

In addition to promotional products, the ability to place an indicia on a product, such as a flashlight is prized by other types of users. For example, collateral products merchandisers such as theme parks (e.g. Walt Disney), movie studios, sports teams, racing teams, schools, universities and the like derive a substantial amount of income from selling products that have visual indicia on them, such as cartoon or movie characters, or team and school logos, pictures of race cars, pictures of drivers and the like on the product.

For the sake of brevity herein, products such as promotional products and collateral merchandise products and affinity that are designed to incorporate some sort of visual indicia, such as an advertising indicia, logo, artwork, team logo or the like, will be referred to collectively as "Promotional Products", it being understood that the term is broad enough to encompass a wide variety of uses including collateral merchandise products.

There are several features that are considered highly desirable in a promotional product. One is that the device be useful and desirable by the end user. As the purpose of a promotional product is to remind the user of the promoting company's existence, the promoting company's ability to remind the user will be significantly enhanced if the product is used often and desired by the user. In contrast, a promotional product of limited use, such as mustache wax, would probably be thrown away by the recipient, thus rendering it unable to remind the consumer of the advertised product or company.

A second desirable feature of a promotional product is that it be manufacturable at a relatively low cost. As many promotional products are sold to the promoting company, but then given by the promoting company to the end customer, it follows naturally that a less expensive product enables the company to stretch its advertising budget further and reach more potential consumers than a relatively more expensive product. Although some promotional products can be quite expensive, and are highly desired for companies to give to especially deserving employees and customers, the larger number of promotional products tend to be less expensive. Additionally, promotional products that are sold (such as those containing pictures of cartoon characters and sport team logos) are preferably kept at a low enough price so that the ultimate customer does not mind purchasing them as an "impulse item".

A third desirable feature is that the promotional product have a configuration that permits a visual indicia, such as a logo, contact information, a message or character to be placed on the product so that it is easily seen.

Currently, a large number of flashlights exist that perform their intended function well and make wonderful promotional products. Some of these promotional products can be seen at The Killion Corporation's BENTCIL catalog and website at www.bentcil.com.

Notwithstanding the existence of these well-performing devices, room for improvement exists. In particular, room for improvement exists in providing a flashlight that provides not only illumination in front of the case in a manner similar to most flashlights, but also provides illumination for a message area so that a visual indicia placed on the flashlight is highlighted and made more prominent, and thereby helps to better illuminate the logo or visual indicia and thereby serve as a better advertising or promotional vehicle.

One object of the present invention is to provide such a device.

SUMMARY OF THE INVENTION

In accordance with the present invention, a flashlight comprises a casing having a first and a second end, a first side surface and a second side surface. The casing comprises a first casing member that is joined to a second casing member. The first and second casing members define an interior cavity there between. The flashlight also includes an electronics package that includes a power source, an actuable switch member and a light array coupled to the power source and switch member. The light source is capable of projecting light outwardly from the first end of the flashlight and also into the cavity. The first casing member includes a light passable portion through which the light projected into the cavity can pass to the exterior of the cavity.

Preferably, the reflector has a concave portion to enhance the upward reflectance of light through the light passable portion and may comprise a light colored plastic sheet, such as a white plastic sheet.

At least one of the first and second casing members includes a slotted portion for defining a tab member that is movable inwardly and outwardly for engaging and actuating the switch member. Additionally, in a most preferred embodiment, the light source comprises a first set of forwardly directed LED bulbs for projecting light forwardly out of the casing of the flashlight, and a second or rearwardly disposed set of LED bulbs that project light rearwardly into the cavity, and ultimately through the light passage portion of the fourth cavity.

One feature of the present invention is that it includes a case having light passable portion. The light passable portion has the advantage of enabling the light that is illuminated interiorly of the casing, to pass outwardly through the case. When a light passable visual indicia or message, such as a logo, picture or the like, is placed over the light passable portion, the light contained within the casing can illuminate the logo or visual indicia.

Another feature of a preferred embodiment of the present invention is that it includes a first and second light source. The first light source is provided for projecting light forwardly out the first end of the casing in a manner similar to the manner in which a traditional flashlight operates. The second light source is provided for providing illumination within the interior cavity of the casing and is positioned and designed to provide light that can pass through the light passable portion of the casing to illuminate the visual message (if any) that is applied to the transparent portion.

In a preferred embodiment, a reflector is provided internally of the casing that is generally co-extensively placed with and slightly larger than the transparent portion. In a most preferred embodiment, the reflector includes a concave surface for reflecting light toward the light passable portion.

Additionally, in a preferred embodiment the casing includes a relatively deeper reflector receiving portion for receiving the concave reflector. Using a "deep" reflector receiving portion and reflector has the advantage of providing better illumination, and better disposition of the illumination so that the light can be better directed to pass through the light passable portion of the case, and thereby better illuminate the visual indicia (if any) that is applied over the transparent portion of the case.

These and other features of the present invention will become apparent to those skilled in the art upon a review of the drawings and detailed description that are contained herein.

DETAILED DESCRIPTION

Figure 1:
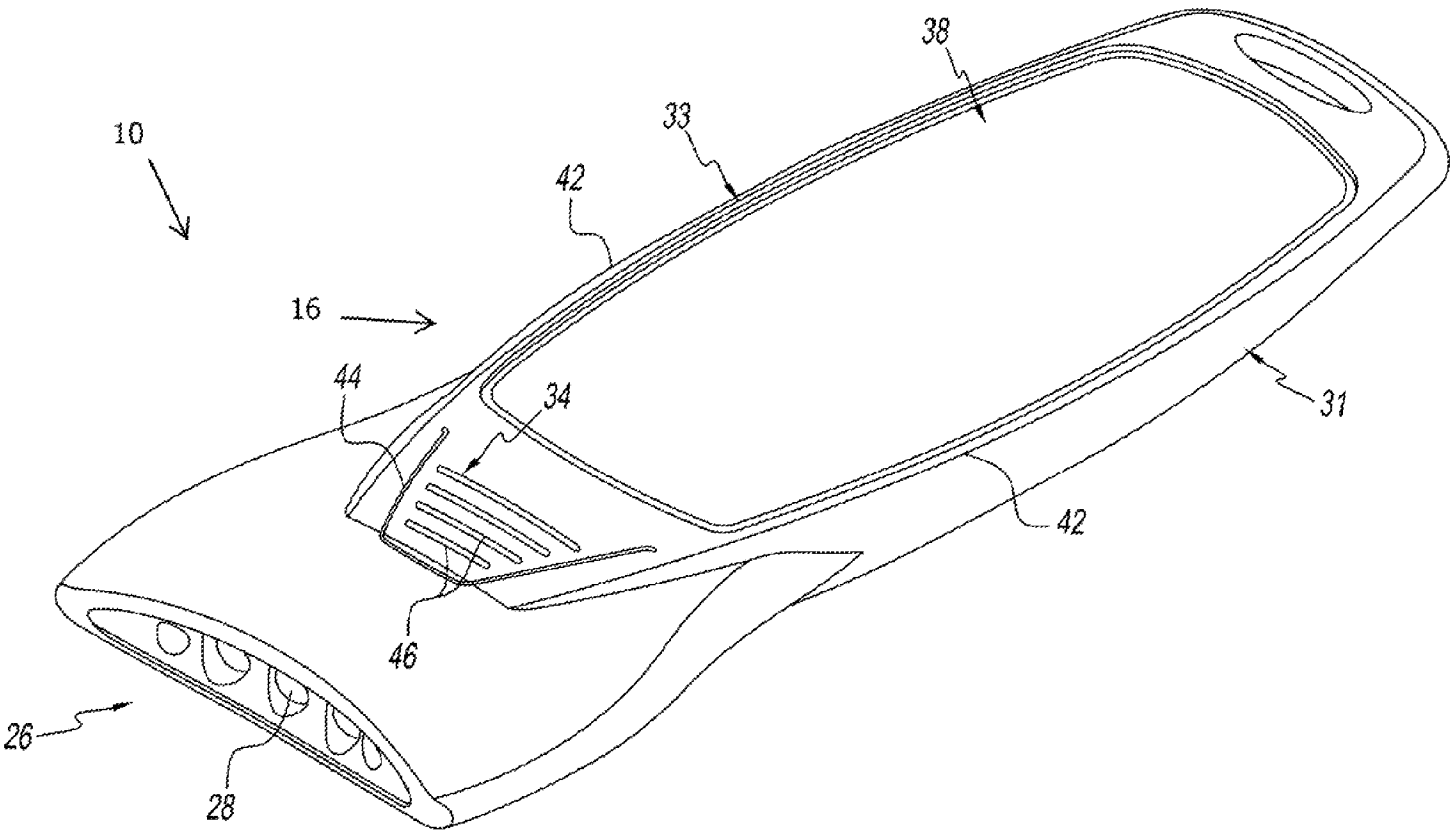
FIG. 1 is a top perspective view of the flashlight of the present invention, primarily showing the forward end of the top surface.
Figure 2:
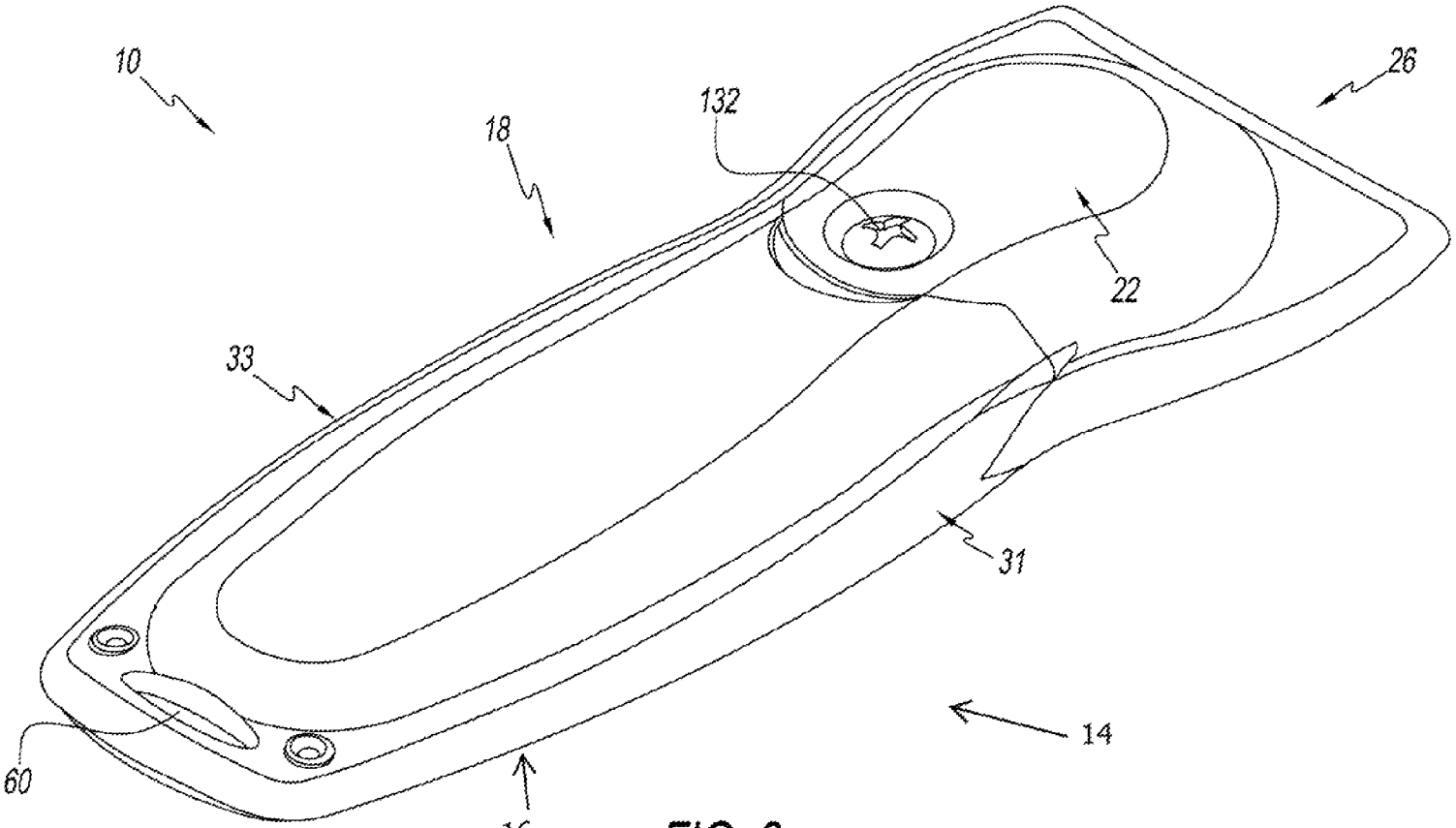
FIG. 2 is a perspective view of the present invention primarily featuring the bottom and rear end of the flashlight of the present invention.

The description that follows describes, illustrates and exemplifies one or more particular embodiments of the present invention in accordance with its principles. This description is not provided to limit the invention to the embodiment or embodiments described herein, but rather to explain and teach the principles of the invention in such a way to enable one of ordinary skill in the art to understand these principles and, with that understanding, be able to apply them to practice not only the embodiment or embodiments described herein, but also other embodiments that may come to mind in accordance with these principles.

The scope of the present invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing reference numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose.

Furthermore, certain views are side views which depict only one side of the vehicle (or one set of components of a multi set array of components), but it will be understood that the opposite side and other component sets are preferably identical thereto. The present specification is intended to be taken as a whole and interpreted in accordance with the principles of the present invention as taught herein and understood by one of ordinary skill in the art.

A flashlight 10 of the present invention is shown in the figures, as comprising a generally "flat" flashlight. As a flat flashlight, the device 10 generally has a length and a width that is substantially greater than its depth. This type of"flat" flashlight 10 is in contrast with a typical cylindrical flashlight.

Flashlights having the "flat" configuration of the flashlight 10 shown in the drawings are possible largely because of advances in battery technology, and LED lighting. Since LED lights produce a large amount of light with a lower power consumption and a highly compact size, a battery smaller than the rectangularly cuboid 9 volt battery, and smaller than the long, cylindrical batteries typically used in flashlights (e.g. Size AAA, Size AA, Size C, and Size D cells) can be employed. Rather, coin-sized, disk-shaped lithium batteries such as are used in the present invention can be employed. As these batteries have much less depth, the flashlight can assume a flatter profile. Also, the size of the flashlight can be reduced since LED lights are usually much smaller than incandescent bulbs.

The flashlight 10 includes a casing 14 that is preferably made of a plastic material, and is most preferably comprised of a rigid injection moldable plastic. The casing 14 includes three primary components, including a first (top) casing member 16, a second (lower) casing member 18, and a cover member 22. The cover member 22 is a part of the second, lower casing member 18, but is formed as a separate part, so as to be separable from the second lower casing member 18. The cover member 22 is designed to be separated from the remainder of the casing 14, so that the users can gain access to the interior of the casing 14 to replace lights and batteries as necessary. The upper 16 and lower 18 casing members define an interior cavity into which the lights, batteries, switches, electronic package 120 and reflector are disposed.

The flashlight 10 includes a forward (or distal) end 26 having a forward-facing light array 28. In the embodiment shown in figures, the light array 28 comprises three forward-facing LED type bulbs 28. The casing 14 of the flashlight 10 also includes a rear (or proximal) end 29. The rear end 29 exists at the proximal terminus of the flashlight 10.

The proximal (rear) portion 13 of the flashlight 10 is disposed adjacent to the rear end 29, and is designed and configured so as to be comfortably gripped by the user. The casing 14 and flashlight 10 also include a first side edge 31 and a second side edge 33. The first and second casing members 16, 18 are joined together along the first and second side edges 31, 33, that are designed to be arcuate in cross section.

The upper casing member 16 includes a switch portion 34. The switch portion 34 is defined by a cut out "slots" 44, that provides a gap between the peninsular switch portion 34 and the remainder of the first casing member 16. This gap formed by the slots enables the peninsular switch portion 34 to move relative to the first casing member 16, in an inward and outward direction arcuately perpendicular to the major plane of the upper casing member 16. This arcuately inward and outward movement of the switch portion 34 enables the peninsular switch portion 34 to engage and actuate an electrical switch by depressing the switch discussed below. As the switch is part of the electronics package 120 of the flashlight 10 of the present invention.

A plurality of grip ridges 46 are formed to extend in a direction generally transverse to the longitudinal axis of the flashlight 10. The grip ridges 46 provide two functions. First, they serve as a "locator". As the flashlight 10 is often used in the dark, the grip ridges 46 provide a tactile stimulation to the user, so that the user can determine the location of the switch portion 34 by feel, so that the user can press downwardly on the grip ridges 46. By pressing downwardly on the grip ridges 46, the user can move the switch portion 34 in a direction generally arcuately perpendicular to the major extent of the plane in which the cover member 16 resides, so that the switch portion 34 can vertically depress the electrical switch that is positioned under the switch portion 34.

Another function served by the grip ridges 46 is that they provide a non-slip surface to better prevent the user's finger from slipping laterally on the switch portion 34 as she moves the switch portion 34 vertically actuate the electrical switch.

The upper casing member 16 is primarily designed to be comprised of an opaque material, and thus have an opaque portion 36. As shown in the drawings, the opaque portion 36 is preferably made from an opaque black plastic. Although the flashlight 10 is shown in the drawing as made from a dark (black) plastic, it will be appreciated that any color plastic (or other material) may be employed, so long as that plastic creates a casing that is relatively opaque. In this regard, a white plastic has the potential to be just as opaque as a black plastic.

The upper casing member 16 also includes a billboard shaped light passable portion 38. The light passable portion 38 is preferably made of a transparent or translucent plastic, and is most preferably made of a transparent plastic. The purpose of the light passable portion 38 is to be transparent so that a light that shines within the interior of the casing 14 will be able to be projected outwardly through the transparent portion 38 so as to illuminate any message that may be contained upon the light passable portion 38.

As one of the features of the flashlight 10 is its ability to contain a large advertising or other message on its surface, and more particularly, to carry a lighted "billboard-type" message on its surface, it is desirable to form the light passable portion 38 to be as large as possible, so as to be able to maximize the size of the message area so as to provide as large of a message as is possible. Nonetheless, the transparent portion 38 should not extend over the entire surface of either the entire casing 14, or for that matter, over the entire surface of the upper member 16.

Rather, the light passable portion 38 and cover 16 should be designed to provide an opaque border 42 that extends around the light passable portion 38 to provide a border for the light passable portion 38. Preferably, the opaque border 42 extends onto the upper surface of the cover member 16, so that the light passable portion 38 does not extend along the side portions.

This sizing is useful because the message is preferably applied to the light passable portion 38 by a sticker such as a decal 50 or other adhesive-containing message vehicle, such as a printed tape, printed sticker, applique or the like. Preferably, the message decal 50 can be large enough to extend over the entire surface of the light passable portion 38, and preferably, extend slightly into the opaque portion 42.

Figure 9:
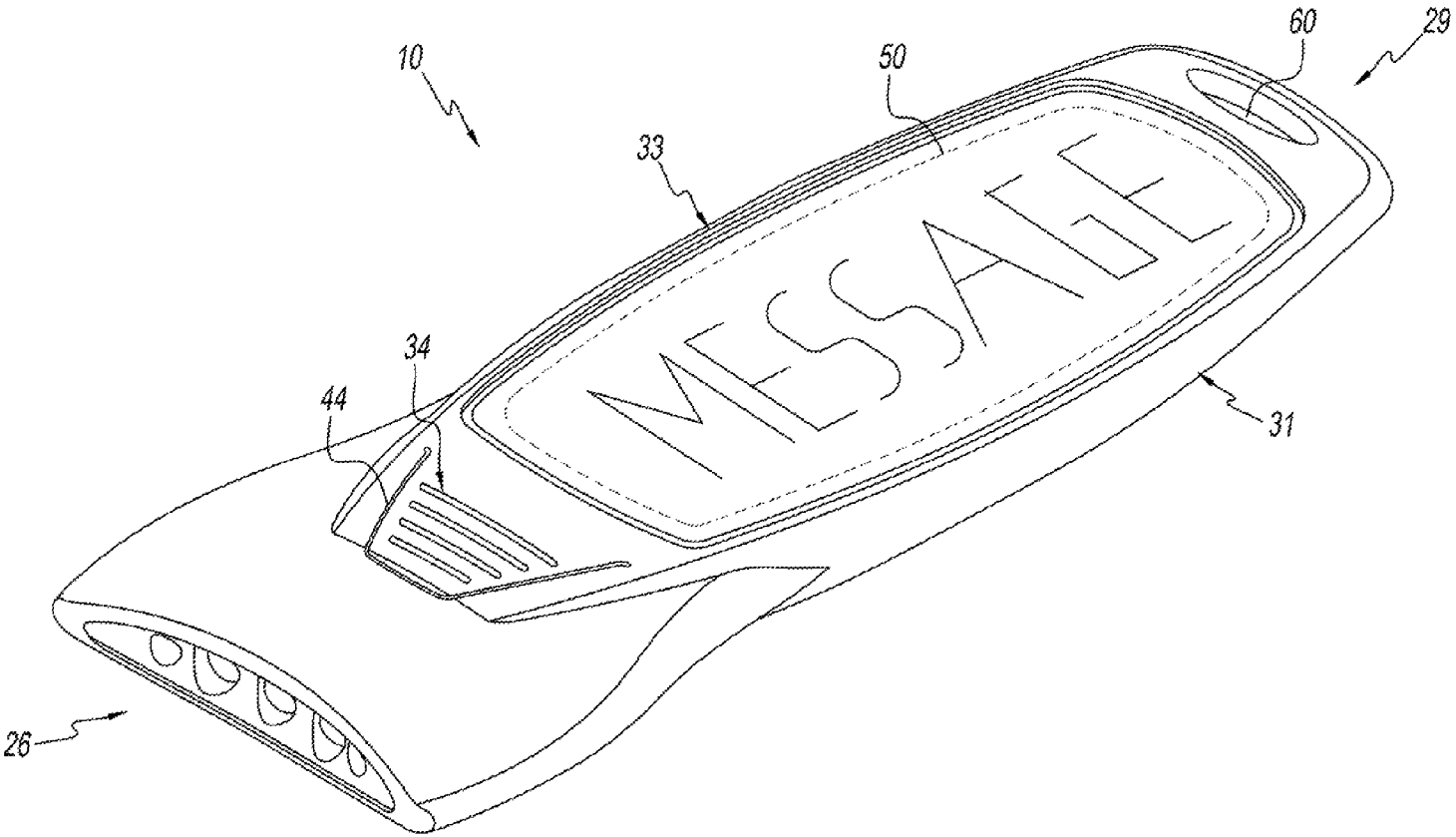
FIG. 9 is a perspective view of the present invention showing a decal placed over the transparent portion bearing a message.
Figure 10:
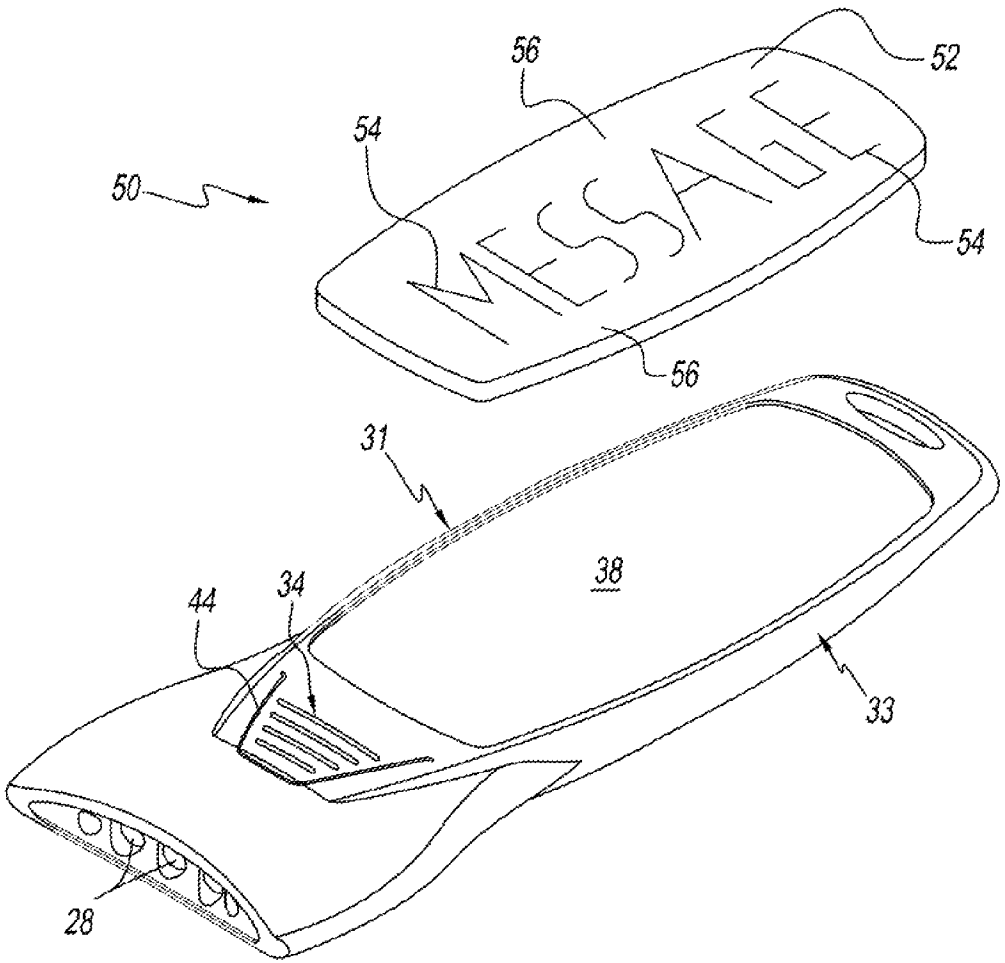
FIG. 10 is an exploded perspective view showing the message decal that is placeable over the transparent portion being separated from the transparent portion.

This arrangement of having a slightly over-sized sticker, such as a decal 50 (see FIGS. 9 and 10) helps to prevent light leaks along the border between the transparent and opaque portions of the casing. Typically, the decal 50 is designed so as to have a relatively more opaque portion 56 and a relatively more light passable portion 54. For example, the decal 50 can have a generally light passable portion 54 that includes transparent or translucent numbers, figures or pictures, so that the light can shine through the light passable pictures, indicia or letters, without shining through the opaque portion 56.

Usually, the area of the decal 50 near the borders of the decal 50 is preferably configured to be opaque such as being printed with an opaque ink. By having the decal slightly larger than the area of the light passable portion, one can help to ensure that the opaque borders of the decal or sticker overlay the transparent or translucent edges of the light passable portion 38 to prevent light leaks around the edges of the light passable portion 38.

The casing 14 also includes an aperture portion 60 disposed near the rear end 29 of casing. The aperture 60 comprises an attachment point where a cord, lanyard, clip (not shown) or other item can be attached to the casing 14 of the flashlight 10, to enhance the utility of the flashlight 10.

Figure 4:
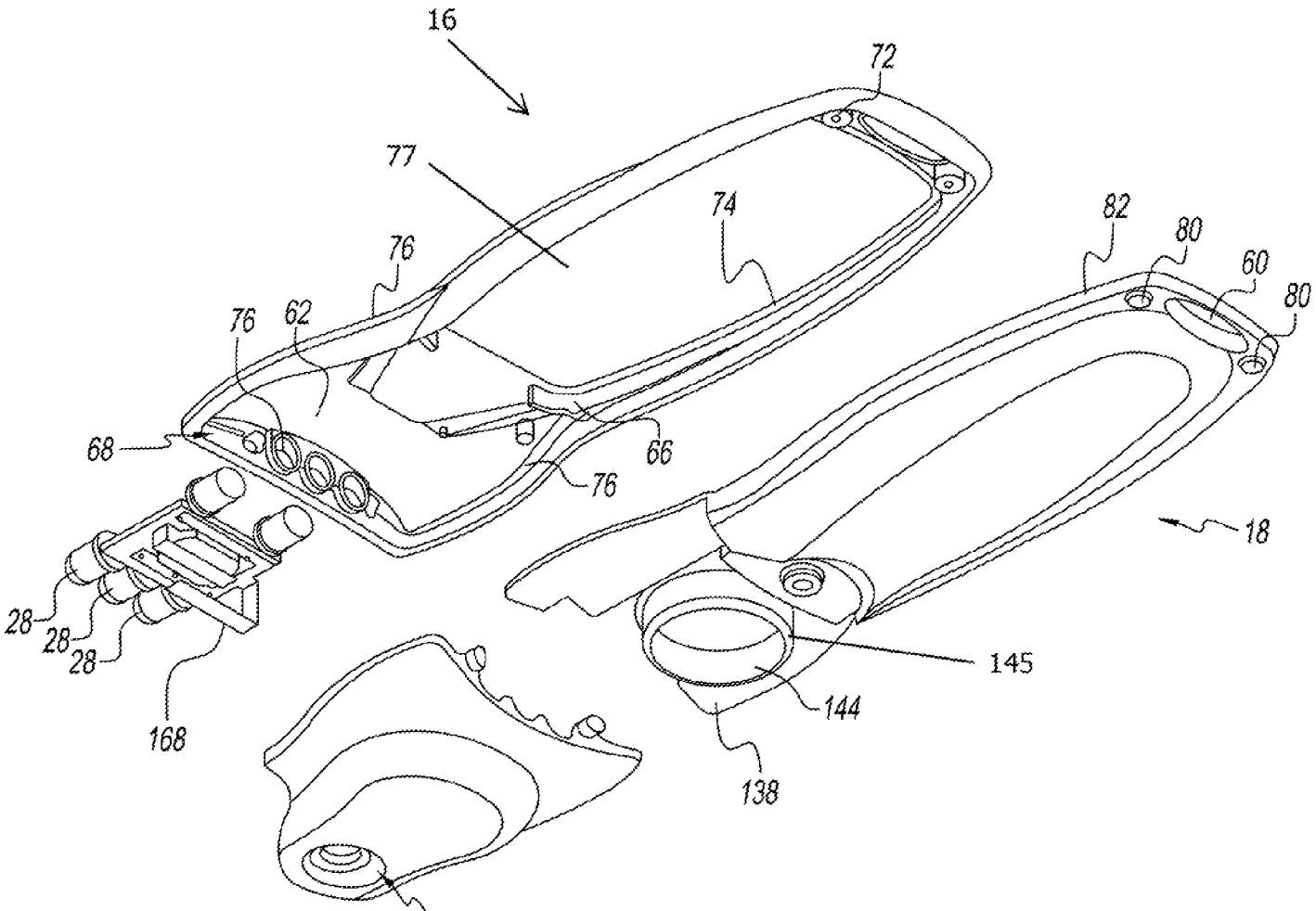
FIG. 4 is another perspective view of the casing, featuring the interior surface of each of the top and bottom members of the casing.

The interior surface 62 of the upper casing member 14 can best be shown with regard to FIGS. 4-8. As best shown in FIG. 4, a forward facing portion 68 is formed at the forward end 26 of the device 10, and extends generally transversely to the major plane of the interior surface 62. The forward facing portion 68 includes a plurality of apertures 76 for receiving the forward facing LED lightbulb(s) 28 that are a part of the electronic package.

A plurality of screw receivers 72 are formed in upper casing member 14 and extend outwardly therefrom, and include a blind passageway that has an axis that is generally perpendicular to the major plane of the interior surface 62. The screw receivers 72 are provided for receiving screws 118 that pass through screw receiving apertures 80 that are formed in the lower case member 18. A transparent portion receiving lip 74 is provided for receiving the perimeter portion of the transparent member that comprises the transparent portion 38. As the transparent portion 38 is made from a transparent material, whereas the remainder of the upper casing 16 is made from an opaque material, it will be appreciated that the transparent portion 38 may either be co-molded with the opaque portion, or else, molded separately as a separate member and then attached to the opaque portion. The transparent portion receiving lip 74 is the annular surface wherein the transparent portion 38 is joined to the opaque portion of the upper casing member 16.

A perimetral lip 77 extends around the perimeter of the upper casing member 16 and is provided for receiving a complimentary perimetral lip 82 of the lower casing member 18.

Figure 5:
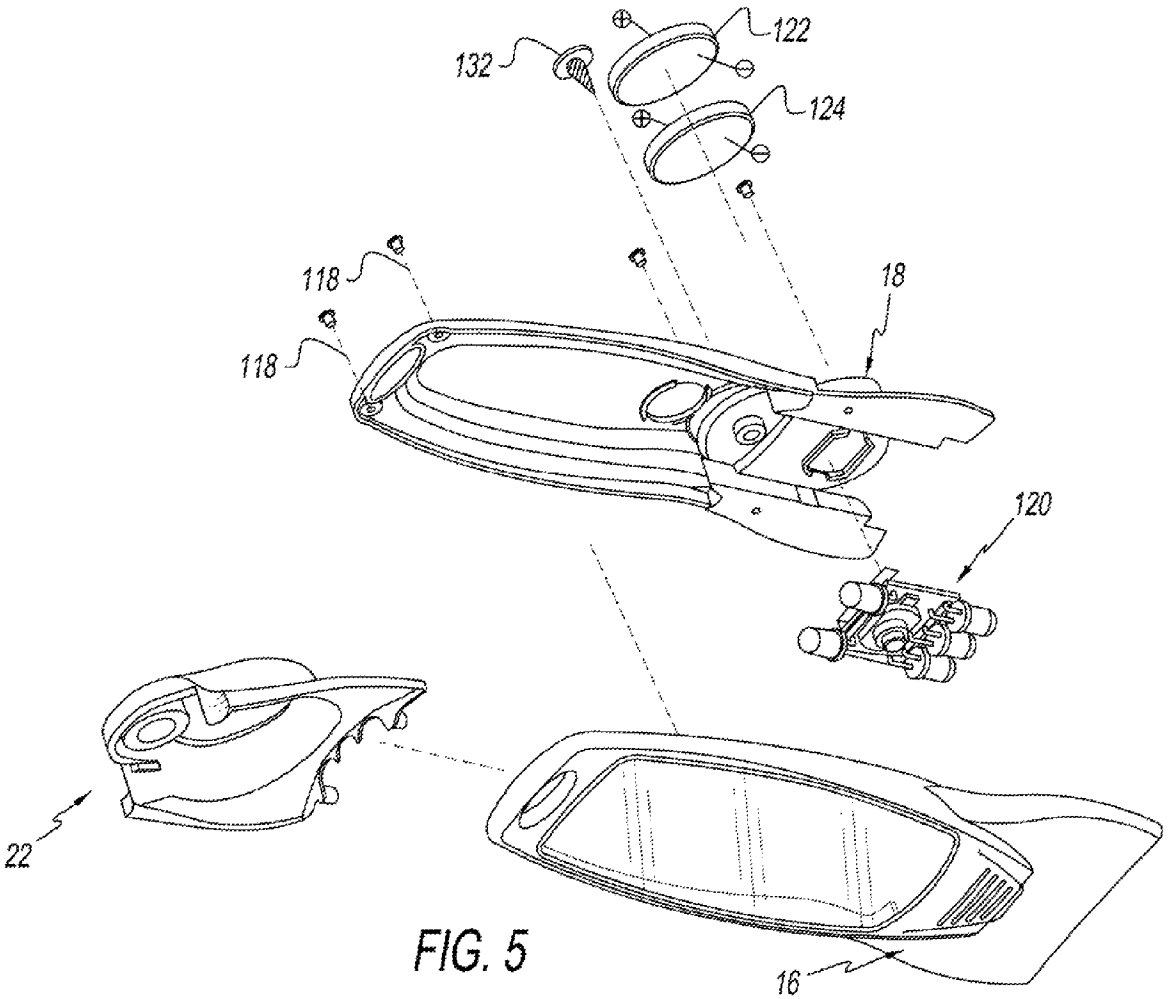
FIG. 5 is an exploded view of the casing, batteries, light and fasteners of the flashlight of the present invention.
Figure 6:
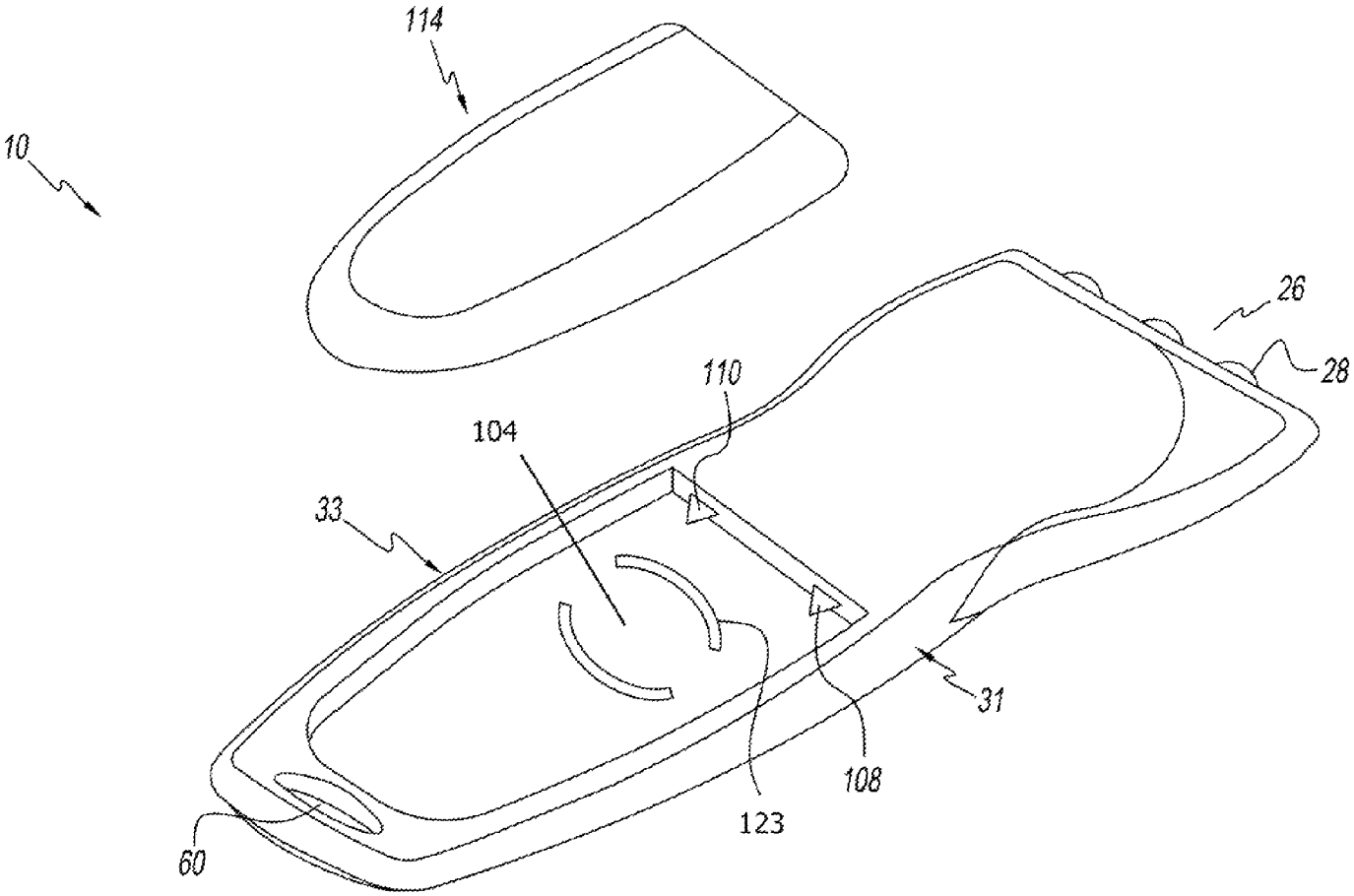
FIG. 6 is an exploded view of the interior of the lower casing member and the sheet-like reflector that is placed therein.

The lower casing member 18 is best shown in FIGS. 5 and 6.

Figure 3:
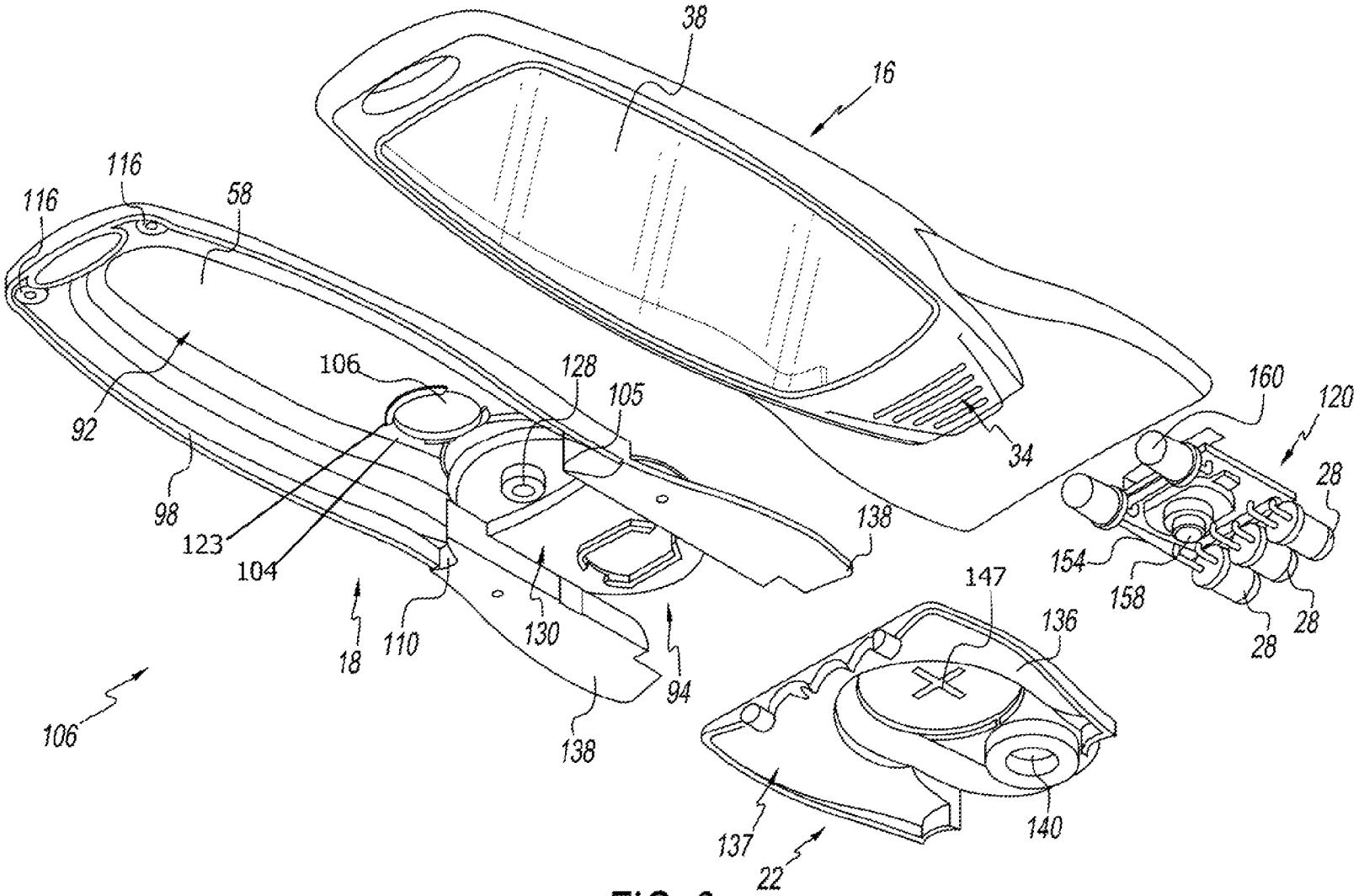
FIG. 3 is a perspective exploded view of the flashlight of the present invention, featuring the outer surfaces of each of the top and bottom surfaces of the casing.

FIGS. 3-4 show the interior surface 88 of the second or lower casing member 18, and FIG. 6 shows the exterior surface of the lower casing member 18 (with the reflector member 114 removed). The lower casing member 18 includes a rear cavity portion 92 and a frontal cavity portion 94. The rear cavity portion 92 is disposed adjacent to the rear end 29 of the flashlight 10, and the frontal cavity portion 94 is disposed adjacent to the front end 26 of the flashlight. The frontal cavity 94 is covered over by the cover member 22 whereas the rear portion cavity 92 has as its exterior surface the lower casing member 18. The rear cavity 92 includes a perimetral lip 98, and has a depth, when measured between the perimetral lip 98, and the exterior surface of the lower member 18 of approximately 10 mm, with a depth of the cavity itself (when measured from the perimetral lip 98) being about 8 or 9 mm. The generally centrally disposed "cavity" has a relatively greater depth than the depth of the relatively shallower perimetral portion of the cavity area.

Figure 8:
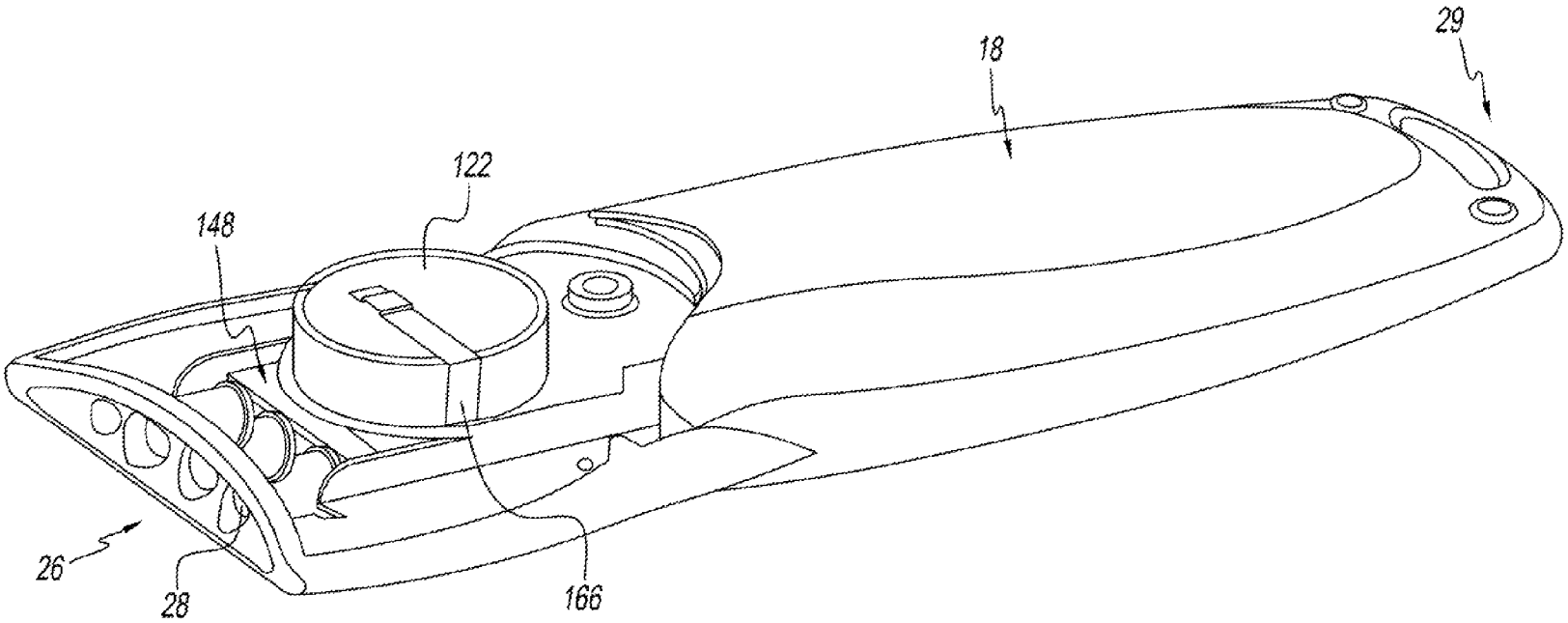
FIG. 8 is a perspective view, partially broken away, wherein the forward portion of the bottom cover is removed, but otherwise, the underside surface of the flashlight is featured.

It will be appreciated that this depth is deeper than one would otherwise need to house the necessary components. This depth is provided so as to create a light reflecting cavity space 92 between an upper surface of a generally planar, sheet-like reflective member 114, and the interior (underside) surface of the transparent portion 38. As shown in FIG. 8, the reflector member 114 is a generally sheet-like and possibly concave and has a reflective upper surface. The reflective member 114 can achieve its reflective capabilities by being made from a plastic sheet having a light color. Preferably the attractive member is made from a white plastic material which generally reflects light well. Alternately, the interior facing surface 115 can be formed, such as by stamping, to be concave to help better focus and reflect the light within the interior cavity of the flashlight 10 upwardly through the transport portion 38 of the casing 16, and the message containing decal 50 thereon. The lower surface of the reflector rests on the interior surface 88 of the rear cavity portion 92. Because of the shape of the interior cavity of the lower casing member 18, one can also achieve some concavity of the reflector 114 by making the width of the reflector 114 slightly wider the width of the interior of the lower casing member 18, so that the reflector 114 bends concavely when squeezed in the cavity.

First and second fingers 108, 110 are disposed adjacent to the frontal area of the rear cavity portion 92, and contain a space between the underside surface of the first and second fingers 108, 110 and the interior surface 88 of the rear cavity portion, that has a sufficient height so as to receive the front edge of the sheet-like reflector member 114 to maintain the sheet-like reflector 114 in its appropriate position adjacent to the interior surface 88 of the rear cavity portion 92.

A raised arcuate ridge 123 that extends upwardly from the interior surface 88 is sized, shaped and configured to define a seat 104 interiorly of the arcuate ridge 123 for receiving a disk-shaped magnet 106. The disk-shaped magnet 106 (FIG. 5) is sized and positioned for being received in the seat 104. The magnet 106 is held in position both by the upstanding ridges 123 on the side, and the sheet-like reflector 114 that overlays the top surface of the magnet 106 thereby holding it in place. A pair of screw receiving apertures 116 are provided adjacent to the rear end of the second (lower) case member 18, through which screws 118 can pass for fixedly coupling the lower case member 18 to upper case member 16.

The front cavity 94 of the interior of the lower case member 18 is sized, configured and designed for receiving an electronics package 120 along with first and second coin-sized, disk-shaped batteries 122, 124. Examples of batteries 122, 124 that will function well in the present invention are size number CR2032, three-volt lithium batteries, that are available from a wide variety of sources. A pair of such batteries 122, 124 are placed in series within the housing.

A generally cylindrical interiorly threaded screw receiver 128 is formed along the interior surface 130 of the frontal cavity 94. The threaded screw receiving cavity 128 has an axis that is generally transverse to the major plane of the interior surface 88 of the lower casing member 18, and is sized and positioned for receiving a screw 132. The screw 132 is sized and configured to extend through a screw receiving aperture 140 that extends through the cover member 22, for fixedly but removably coupling the cover member 22 to the lower housing member 18.

The lower casing member 18 includes a pair of forwardly extending positioning legs 138 at its forward most extent. The forward extending positioning legs 138 have a generally planar upper surface for being placed in an adjacent, opposed relationship to the generally planar peripheral and frontal planar portions 136 of the interior surface 137 of the cover member 22.

Turning now to FIG. 4, the exterior surface 142 of the frontal portion of the lower casing member 18 is shown. The exterior surface 142 is disposed exteriorly only relative to the interior surface 88 of the lower casing member 18. In practice, the exterior surface 142 is hidden from view by being disposed interiorly of the cover member 22 which overlays surface 142.

A generally cylindrical battery receiving dish 144 having a circular upstanding wall 145 defines a cavity therein, the cavity is provided for receiving first and second batteries 122, 124. As discussed above, the batteries 122, 124 are preferably disk-shaped lithium batteries that are placed in a series, such that the negative poles of each of the batteries are placed relatively closer to the floor of the battery receiving dish 144, and that the positive poles are positioned relatively closer to the interior surface 137 of the cover member. As shown in FIG. 3, a "+" is embossed into the battery receiving dish portion 147 that is formed on the interior surface 137 of the cover portion 22.

The cover member 22 is sized, configured and positioned to fit over the frontal portion of the lower casing member 18, and to be removably attached thereto. The cover member 22 is removably attachable to enable the user to replace the batteries 122, 124 when they wear out. It will be appreciated that the device could also be designed for "one time" disposable use if the cover member 22 were permanently attached to the lower cavity member 18, such as by sonic bonding, gluing or the like, rather than being removably attached, through the use of attachment screw 132.

Additionally, the batteries 122, 124 could be rechargeable batteries with a charger receiving port coupled to the casing 14 for receiving a charger. The front end of the cover member 22 includes a pair of axially, extending spaced bosses 146 that are received by corresponding blind apertures of the forward member of the upper casing portion, to properly position the cover member 22 with respect to the upper casing member 16.

The electronics package 120 is best described with regard to FIGS. 3, 5, 7 and 9. The electronics package includes a central circuit board member 148 that serves as a "frame" for the electronics package 120. The circuit board member 148 includes a lower surface 152 that is disposed adjacent to the batteries 122, 124 and an upper surface 154 that is disposed adjacent to the electronic package platform receiving surface 130 of the forward portion 94 of the lower casing member 18.

A depressible on/off switch 158 is coupled onto the upper surface 154 of the circuit board member 148 and when inserted into the completed flashlight 10 is disposed under the depressible switch-engaging portion 34 of the upper housing 16. As discussed above, the depressible switch-engaging portion 34 includes a cut out slot 44 that enables the switch engaging portion 34 to be moved arcuately inwardly and outwardly (relative to the plane of the upper casing 16 about an axis that is generally parallel to the axis of the grip engaging ridges 146. By moving upwardly and downwardly, the switch-engaging portion 34 can engage the depressible button of the switch 158 to open and close the switch 158 and thereby turn on and turn off the forwardly directed lights 28 and the rearwardly directed lights 160 of the electronics package 120.

The electronics package also includes three forwardly projecting lights 28 that extend through the apertures 76 on the front surface 68 of the flashlight 10 to project a beam of light forwardly of the flashlight 10. Additionally, two rearwardly disposed lights 160 are provided on the opposite side of the circuit board 148, for projecting and shining light rearwardly into the cavity 92 of the rear portion of the flashlight in between the reflector 114 and the transparent portion 38 of the upper casing member 16.

This cavity 92 is positioned interiorly of and adjacent to the transparent portion 38 of the upper cavity member 16 so that the light emitted by the rear light members 160 will shine through the transparent portion 38. As discussed above, the reflector 114 helps to defuse the light evenly and throughout the transparent portion 38, so that a generally uniform light (as opposed to one having extreme bright spots and dull spots) is passed through the transparent portion 38.

Figure 7:
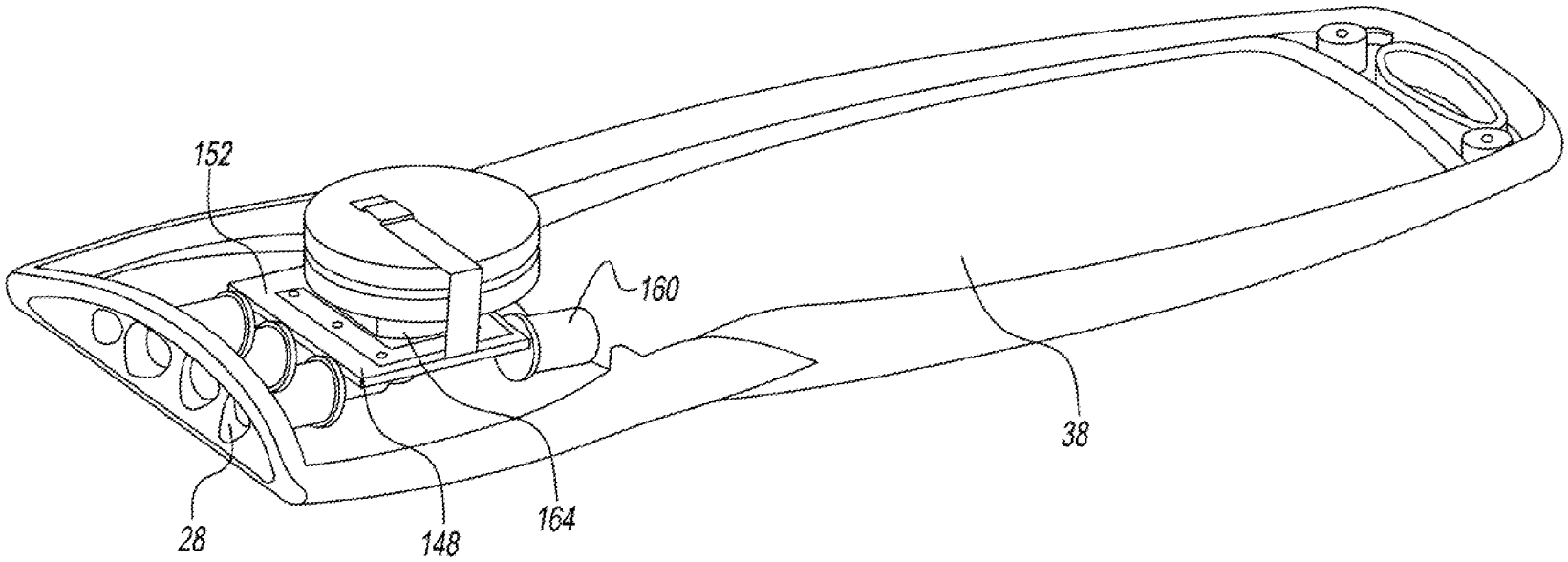
FIG. 7 is an underside view of the top casing member and the electronic package used with the device.

Shown in FIGS. 7 and 8, the light that shines through the light passable portion 38 of the upper casing 16 can shine through the transparent light passable portion 54 of the decal 50 that is placed over the transparent portion 38 of the casing 14, so that the message that comprises the transparent portion 54 of the decal 50 is illuminated. Although the decal type sticker 50 is conceptually divided into opaque portions 56 through which light cannot pass and transparent or otherwise light passable portions 54 through which light can pass, it will be appreciated that the decal 50 can be printed to have several discrete light passable portions 54. For example, the decal 50 can have light passable portions 54 that comprise the discrete letters shown in FIG. 12, or in multi-colored design, such as an American flag having white light passable portions, red light passable portions and blue light passable portions, which although different in color, are similar in their ability to allow light to pass there through.

The electronics package 120 also includes a series of connectors that can be ribbon-like connectors, wires or other connectors that extend between the batteries 120, 122 and the pole engaging connector 164 that directly engages the negative pole of the batteries 120, 122.

A second connector 166 that comprises a ribbon-like positive pole connector member 166 extends between the circuit board 148 and the positive pole of first battery 122.

The platform portion of the front portion of casing lower member 18 can include a slot through which the ribbon connector 166 can pass to properly position the ribbon 166 adjacent to the positive pole of the battery 122, and to also help to secure the circuit board member 148 onto its appropriate position on the platform between the forwardly extending legs 138.

In operation, the flashlight 10 is assembled and the batteries 122, 124 are installed. To turn the light on, the switch depressing area 34 of the upper casing member 16 is pressed downwardly to engage the switch 158 of the electronics package 120. By closing the circuit, the switch 158 permits electricity to flow from the batteries 122, 124 through the electronics package 120 and to light up the forwardly facing lights 28 and the rearwardly facing lights 160.

The forwardly facing lights 28 shine outwardly and provide an illuminated beam in a manner similar to that practiced by other flashlights. Concurrently, the rearwardly disposed lights 160 illuminate the cavity 92 in the rear portion of the flashlight 10 that allows light to pass through the transparent portion 38 of the upper casing member 16.

The light that passes through the transparent portion 38 passes through those light passable portions 54 of the decal 50 that are adhesively applied to the exterior surface of the light passable portion 38 of the casing 14.

The light given off by the rearwardly facing lights 160 and reflected by the reflector 114 illuminates the message 54 contained on the decal 50, that for the reasons discussed above, has great value to a company that employs this device as a promotional product to help promote the company's other products. Additionally, this lighted up display will have great utility to those who purchase the flashlight 50 as a collateral product, to show for example, affinity with a particular college, school, amusement character or the like.

Having described the invention in detail with reference to certain preferred embodiments, it will be appreciated that variations and modifications exist within the scope and spirit of the present invention, and that the invention should not be limited to the embodiment shown herein, but rather, should be expanded to include all variations, modifications and equivalents contained within the scope and spirit of the invention, and the claims appended hereto.

What is claimed is:

1. A flashlight comprising a casing having a first end, a second end, a first side surface, and a second side surface, the casing comprising a first casing member joined to a second casing member, the first and second casing members defining an interior cavity there between an electronics package including a power source, an actuable switch member, and a light array coupled to the power source and switch member, the light source being capable of projecting light outwardly from the first end of the flashlight and into the cavity, wherein the first casing member includes a light passable portion through which the light projected into the cavity can pass to the exterior of the casing.

2. The flashlight of claim 1 further comprising a reflector member disposed in the cavity for reflecting light projected into the cavity outwardly through the light passable portion.

3. The flashlight of claim 2 wherein the reflector member has a concave portion to enhance the upward reflectance of light through the light passable portion.

4. The flashlight of claim 3 wherein the reflector comprises a plastic sheet having a reflective surface, and a width greater than the width of the cavity to cause the reflector to bend concavely to fit within the cavity, and wherein the cavity includes a centrally disposed relatively deeper portion and a perimetrally disposed relatively shallower portion.

5. The flashlight of claim 3 wherein the reflector comprises a three dimensionally formed plastic sheet.

6. The flashlight of claim 3 wherein the reflector member comprises at least one of a generally white sheet and a sheet member having a reflective coating thereon.

7. The flashlight of claim 2 wherein the light array comprises at least one forward projecting light for projecting light outwardly from the first end of the flashlight, and a rearward projecting light for projecting light into the cavity.

8. The flashlight of claim 7 wherein the forward projecting light comprises at least two light emitting diodes.

9. The flashlight of claim 7 wherein the light passable portion comprises a generally transparent portion of the first casing member, wherein the remainder of the first casing member is generally opaque.

10. The flashlight of claim 9 wherein the light passable portion includes a sticker receiving surface, further comprising a sticker adhesively placeable on the sticker receiving surface, the sticker including a message printed thereon.

11. The flashlight of claim 10 where the sticker includes a relatively light passable portion and a relatively opaque portion so that light passing through the sticker creates an illuminated message.

12. The flashlight of claim 11 wherein at least one of the first and second casing members includes a slotted portion for defining a tab member movable in an inward and outward direction for engaging and actuating the switch member.

13. The flashlight of claim 11 wherein the slotted portion defines a hinge for connecting the tab member to the casing, wherein the tab can pivot in an arcuate inward and outward path to engage and actuate the switch member.

14. The flashlight of claim 12 wherein the power source comprises at least one battery, the casing includes a battery seat for positioning and holding the at least one battery, and wherein the casing includes a cover member removably coupled to one of the first and second casing members for permitting the user to gain access to the battery seat and at least one battery for facilitating battery replacement.

15. The flashlight of claim 1 wherein the casing includes a cover portion removably coupled to one of the first and second casing members for permitting the user to gain access to the power source.

16. The flashlight of claim 15 wherein the casing includes a battery seat for positioning and holding at least one battery, and wherein the cover member can be selectively detached from the casing for permitting the user to gain access to the battery seat and battery for facilitating battery replacement.

17. The flashlight of claim 15 wherein at least one of the first and second casing members includes a slotted portion for defining a tab member movable in an inwardly and outwardly direction for engaging and actuating the switch member.

18. The flashlight of claim 15 wherein the light array comprises at least one forward projecting light for projecting light outwardly from the first end of the flashlight and a rearward projecting light for projecting light into the cavity.

19. The flashlight of claim 1 wherein the light passable portion comprises a generally transparent portion of the first casing member, wherein the remainder of the first casing member is substantially opaque.

20. The flashlight of claim 1 wherein at least one of the first and second casing members include a slotted portion for defining a tab member movable in an inwardly and outwardly direction for engaging and actuating the switch member.

* * * * *